US006932645B2

(12) United States Patent
Kao

(10) Patent No.: US 6,932,645 B2
(45) Date of Patent: Aug. 23, 2005

(54) STRUCTURE OF SIGNAL PLUG

(75) Inventor: Shih-Chieh Kao, San Diego, CA (US)

(73) Assignee: Capativa Tech, Inc., San Diego, CA (US)

( * ) Notice: Subject to any disclaimer, the term of this patent is extended or adjusted under 35 U.S.C. 154(b) by 0 days.

(21) Appl. No.: 10/748,269

(22) Filed: Dec. 31, 2003

(65) Prior Publication Data

US 2005/0142938 A1 Jun. 30, 2005

(51) Int. Cl.[7] ..... H01R 9/05
(52) U.S. Cl. ..... 439/578
(58) Field of Search ..... 439/578, 583, 439/580

(56) References Cited

U.S. PATENT DOCUMENTS 4,813,887 A * 3/1989 Capp ..... 439/580
5,967,852 A * 10/1999 Follingstad et al. ..... 439/675
6,575,786 B1 * 6/2003 Khemakhem et al. ..... 439/580
6,702,613 B2 * 3/2004 Khemakhem et al. ..... 439/580
6,773,303 B1 * 8/2004 Lin ..... 439/578
6,790,083 B1 * 9/2004 Chen ..... 439/583

* cited by examiner

*Primary Examiner*—Gary Paumen
(74) *Attorney, Agent, or Firm*—Troxell Law Office, PLLC

(57) ABSTRACT

A signal plug including an external sleeve, a line-connecting portion and a plug main-part. The line-connecting portion has two metallic end pieces separated by an insulation member, and a front end extending to form an insertion-connecting portion. The main-part includes the line-connecting portion inserted into a front end of an outer hard metallic receiving portion. The external sleeve is connected to the main-part with the insertion-connecting portion extending outwardly from the external sleeve. The outer receiving portion is made of phosphor bronze and will not deform during assembling. The inner line-connecting portion is made of high electric conductivity copper.

8 Claims, 4 Drawing Sheets

STRUCTURE OF SIGNAL PLUG

BACKGROUND OF THE INVENTION

1. Field of the Invention

The present invention is related to an improved structure of signal plug, and especially to a signal plug integrally formed from high electric conductivity copper member and phosphor bronze member, in order that the plug can have good connection strength after assembling, and can have a high-quality signal transmission effect. It is applicable to converting signals in audio and video equipment of high picture quality as well as high sound quality.

2. Description of the Prior Art

With advancing of the time, life standard is relatively elevated. Many products satisfying people in substance enjoyment, such as audio and video equipment, are more and more life-oriented and popularized; these products that can elevate the life quality surely will be given with relative requirements, for example, requirements for the quality of sound of a Hi-Fi set, the colors of a television set and the degree of analyzing of a picture etc. Therefore, in transmitting signals to audio and video equipment such as a Hi-Fi set and a television set etc., signal lines and signal plugs used for transmitting take quite an important role.

As shown in FIG. 1, a conventional signal plug includes an external pipe 1 and a plug portion 2, wherein the plug portion 2 includes a prong 21 and a connecting piece 22. The front end of the external pipe 1 has a thread 23 for making connecting of the external pipe 1 with the plug portion 2. Thereby, when a signal line is connected into the plug portion 2, signals can be sent out through the plug portion 2.

A conventional signal plug generally is made from phosphor bronze sheet. Due to the reason that the phosphor bronze sheet is hard, and while in designing of the conventional signal plug the connecting piece generally protrudes out, plugging connections for multiple times will make the phosphor bronze sheet loosened to result in inferior contact. And the phosphor bronze sheet is not a high electric conductivity material, it cannot present the effect of higher quality of the audio and video equipment in transmitting signals.

SUMMARY OF THE INVENTION

The primary object of the present invention is to provide an improved structure of signal plug, in which a high electric conductivity copper member and a phosphor bronze member can be integrally formed to have good connection strength after assembling. The signal plug has the effect of high quality in signal transmitting.

To achieve the above stated object, the improved structure of a signal plug provided in the present invention comprises an external sleeve, a line-connecting portion and a plug main-part. Wherein the plug main-part is composed of an outer hard metallic receiving portion being inserted therein on the front end thereof with the high electric conductivity metallic line-connecting portion. The line-connecting portion has two metallic end pieces separated by an insulation member; the front end of the line-connecting portion extends to form an insertion-connecting portion of the signal plug. The metallic receiving portion is made by turning of lathe work into a cylinder of phosphor bronze, of which the two ends has holes, the cylinder has lock holes on the rear cylindrical wall thereof and is excavated on the upper side thereof to form an opening. The line-connecting portion is made of high electric conductivity copper, of which an end piece has a front portion in the form of a barrel with circling petal-like blades and has an insulation member enveloped inside of the root portion thereof, and from which a prong-like end piece extends out centrally thereof to be separated from the former end piece. The external sleeve is connected with the plug main-part to render the insertion-connecting portion exposed.

Thereby, because the outer receiving portion is made of phosphor bronze, it can keep proper connection strength, and will not deform during assembling, while the inner line-connecting portion is made of high electric conductivity copper; thereby quality in signal transmitting of the signal plug can be largely increased, the signal plug is applicable to applying in converting signals in audio and video equipment of high picture quality as well as high sound quality such as a Hi-Fi set and a television set etc.

The present invention will be apparent after reading the detailed description of the preferred embodiment thereof in reference to the accompanying drawings.

DETAILED DESCRIPTION OF THE PREFERRED EMBODIMENT

Figure 1:
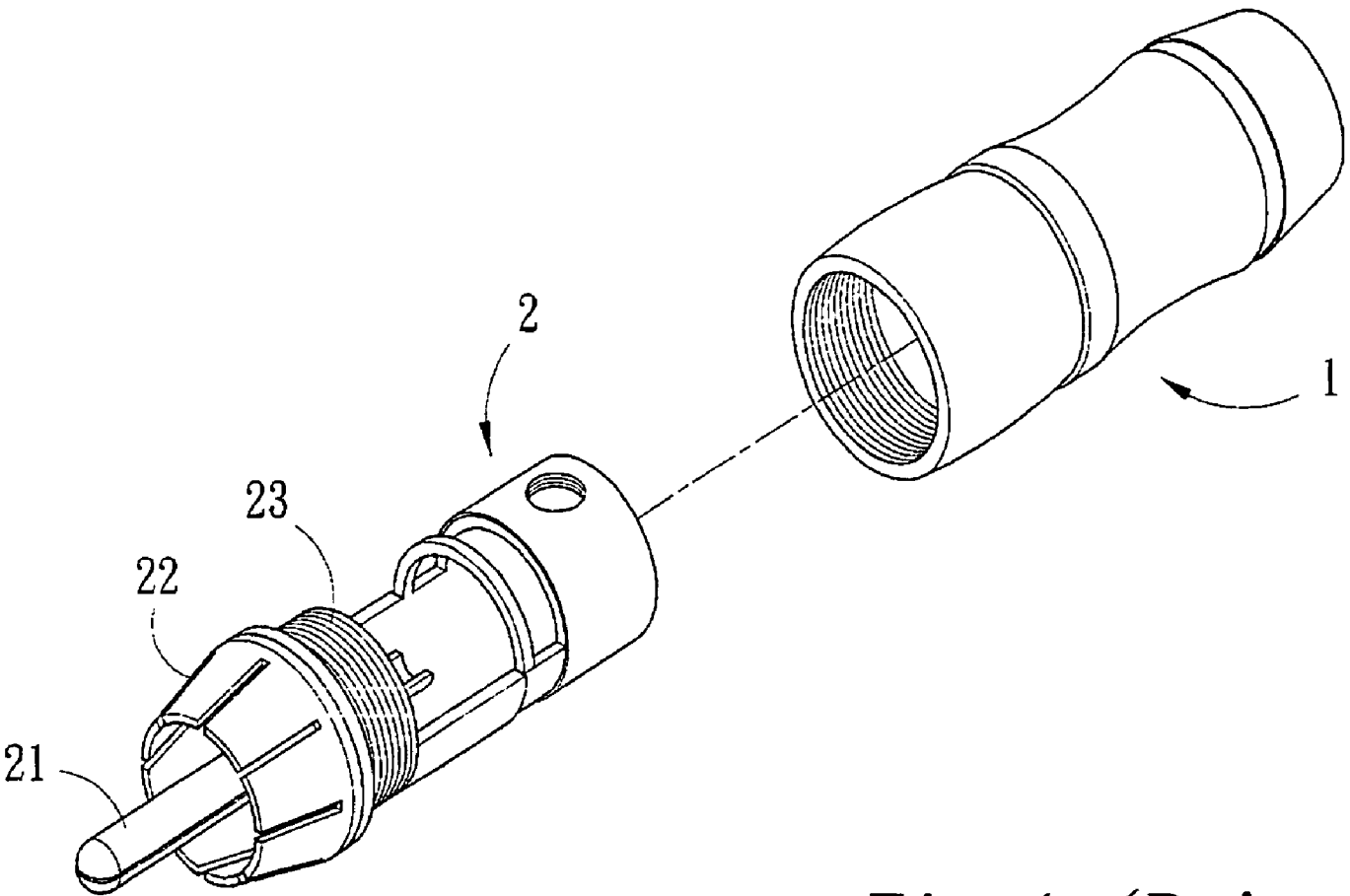
Fig. 1 (Prior Art)
FIG. 1 is a perspective view showing the appearance of a conventional signal plug.
Figure 2:
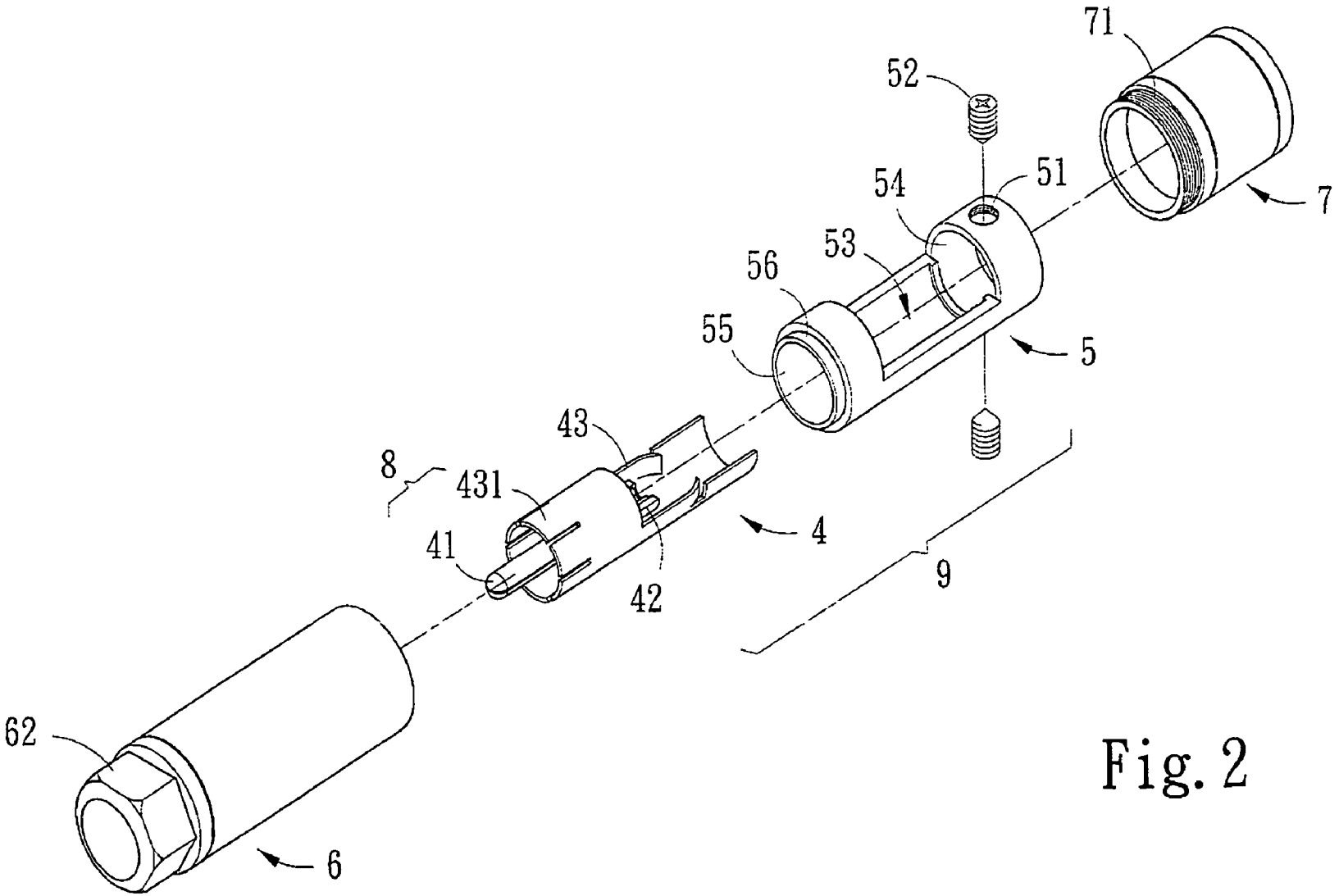
FIG. 2 is an analytical perspective view showing the elements of the embodiment of a signal plug of the present invention.
Figure 3:
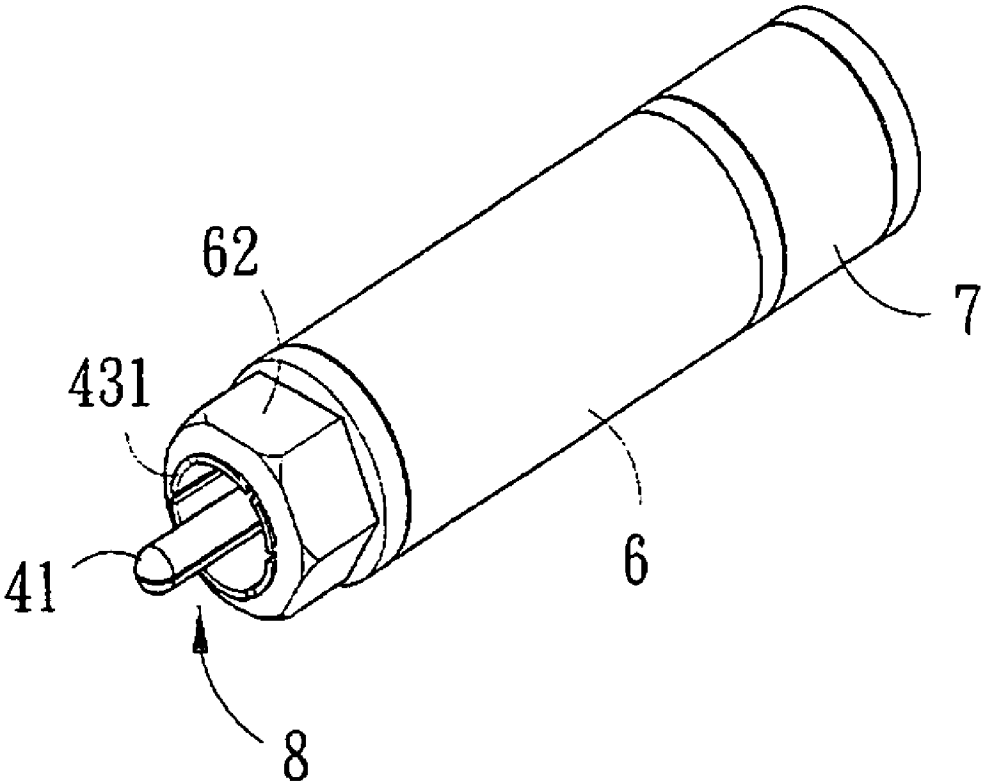
FIG. 3 is a perspective view showing the appearance of the embodiment of the signal plug of the present invention.
Figure 4:
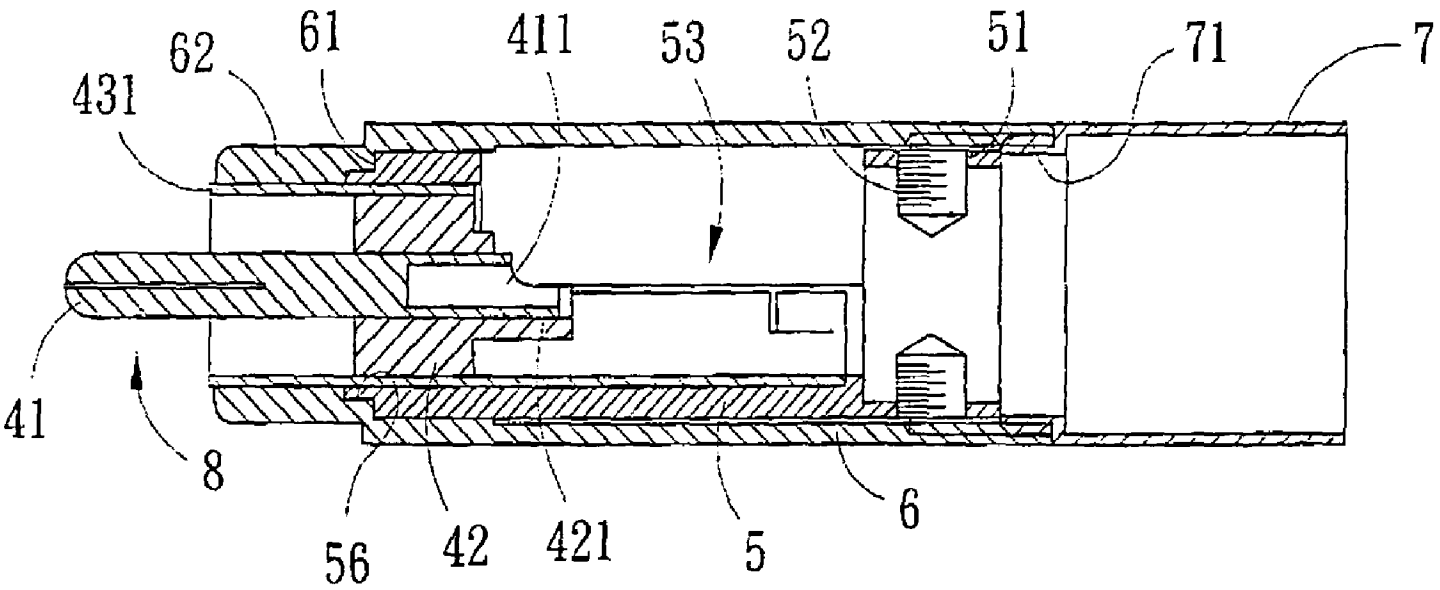
FIG. 4 is a sectional view of the embodiment of the signal plug of the present invention.

Referring to FIGS. 2–4, the improved structure of signal plug of the present invention comprises an external sleeve 6, a line-connecting portion 4 and a plug main-part 9. Wherein the plug main-part 9 is composed of an outer hard metallic receiving portion 5 with the metallic high electric conductivity line-connecting portion 4 inserted in a front end of the metallic receiving portion. The line-connecting portion 4 has two metallic end pieces 41, 43 separated by an insulation member 42, the front end of the line-connecting portion 4 extends to form an insertion-connecting portion 8 of the signal plug. The metallic receiving portion 5 is made by turning of lathe work into a cylinder of phosphor bronze, of which the ends have holes 54, 55. The cylinder has on the rear cylindrical wall thereof lock holes 51 and on a upper side thereof has an opening 53. The line-connecting portion 4 is made of high electric conductivity copper, of which the end piece 43 has a front portion in the form of a barrel with circling petal-like blades and has the insulation member 42 enveloped inside of the root portion thereof, and from which the prong-like end piece 41 extends out centrally thereof to be separated from the former end piece 43. The external sleeve 6 is connected with the plug main-part 9 with the insertion-connecting portion 8 extending outwardly from the external sleeve.

When in practicing, the plug main-part 9 can be a male or a female main-part; it is depicted in the drawings as a male main-part just by way of an example. The present invention can adopt the conventional way to make threads by turning in the metallic receiving portion 5 and the external sleeve 6 of the plug main-part 9 for connecting the two (not shown), or as are shown in FIGS. 2 and 3, the front end of the metallic receiving portion 5 has a shoulder 56, while the front end of the external sleeve 6 has a radially reduced portion 62 having a through hole, the rear end of the external sleeve 6 has a thread for screw connecting with a fixing sleeve 7, so that the metallic receiving portion 5 of the plug main-part 9 can be fixedly clamped in the external sleeve 6.

In particular, please refer to FIGS. 2–4, the improved structure of signal plug of the present invention comprises a line-connecting portion 4, a receiving portion 5, an external sleeve 6 and a fixing sleeve 7.

The line-connecting portion 4 includes a prong-like end piece 41, an insulation member 42 and an end piece 43; wherein the prong-like end piece 41 is made of high electric conductivity copper to form a round thin rod by way of drawing, and has on the rear end thereof a channel 411 for welding a signal line; the insulation member 42 is a hollow cylinder made of plastic, it has on one end provided with a semicircular channel 421. When the prong-like end piece 41 is extended through the insulation member 42, its front end is protruded out of the insulation member 42, while the channel 411 on the rear end thereof is clung on the inside of the semicircular channel 421. The other end piece 43 is made of high electric conductivity copper by punching and folding, the rear portion of it is an annular channel for line welding; while the front portion of it is in the form of a barrel with a plurality of uniformly distributed circling blades 431 and the root portion of it is enveloped therein with the insulation member 42 together with the prong-like end piece 41. The front end of the prong-like end piece 41 extends out of the circling blades 431.

The front end of the receiving portion 5 connects with the rear end of the line-connecting portion 4, so that the circling blades 431 and the front end of the prong-like end piece 41 are exposed to the outside; the receiving portion 5 has an opening 53 on the middle section thereof, and has two lock holes 51 on the surface of the rear end thereof. When a signal line is welded to the line-connecting portion 4, screws 52 can be locked in to fix the signal line (as shown in FIG. 2).

Because the line-connecting portion 4 is made of high electric conductivity copper which is soft and will be deformed and unable to afford processing when it is turned in a lathe work. It is borne on the receiving portion 5 in order that it will not deform when connecting with the external sleeve 6. In assembling, the external sleeve 6 can envelop the line-connecting portion 4 and the receiving portion 5 in it, the radially reduced portion 62 having a through hole exactly forms therein a stop portion 61 for stopping the shoulder 56 of the metallic receiving portion 5. The metallic receiving portion 5 then is fixed by the fixing sleeve 7 having a thread 71 on the front end thereof, the fixing sleeve 7 is screw connected with the external sleeve 6 to abut against the metallic receiving portion 5. The plug main-part 9 is placed in the external sleeve 6 and connected thereto, the front portion with the circling blades 431 of the line-connecting portion 4 is deeply extended into the radially reduced portion 62 with only a part of the upper edge thereof exposed. When in connecting, the front end of the external sleeve 6 envelops the circling blades 431 and allows only protruding of the prong-like end piece 41 outside to avoid the circling blades 431 from deformation by an external force.

For the convenience of assembling and dismantling of the external sleeve 6 of the present invention, and for the sake of aesthetic appearance, the surface of the front end of the external sleeve 6 is molded as a polygonal shape; hence it is easy for assembling and dismantling.

In conclusion, according to the description disclosed above, the present invention surely can achieve the expected object thereof to provide an improved structure of signal plug which can increase the quality of signal transmitting.

Having thus described the technical structure of my invention with the value of utility, therefore, what I claim as new and desire to be secured by Letters Patent of the United States are:

1. A signal plug comprising:

a) main plug part having:

i) a metallic receiving portion; and ii) a line connecting portion inserted into the metallic receiving portion and having an insulation member, two metallic pieces separated by the insulation member, and an insertion-connecting portion formed on a front end thereof;

b) an external sleeve connected to the main plug part and having a hole on a first end thereof, the insertion-connecting portion protruding outwardly from the hole, the external sleeve having:

i) a second hole located on a second end, the second hole communicating with the first hole;

ii) two lock holes on the second end thereof; and iii) an opening in a peripheral wall;

wherein a first metallic piece of the two metallic pieces includes a barrel having a plurality of blades, the insulation member is located in an interior of the barrel, a second metallic piece of the two metallic pieces includes a prong piece protruding from a center of the barrel, the line connecting portion is made of copper.

2. The signal plug according to claim 1, further comprising a fixing sleeve having a first thread, the metallic receiving portion including a shoulder on a front end thereof, the external sleeve including a radially reduced portion on the first end and a second thread on a second end thereof, the external sleeve is connected to the fixing sleeve by the first thread engaging the second thread thereby fixing the main plug part in the external sleeve.

3. The signal plug according to claim 2, wherein an exterior of the radially reduced portion has a polygonal cross section.

4. The signal plug according to claim 1, wherein the main plug part is inserted into the external sleeve, the plurality of blades of the barrel of the main plug part are inserted into the radially reduced portion of the external sleeve with a predetermined length of the plurality of blades extending outwardly from the external sleeve.

5. The signal plug according to claim 1, wherein the main plug part is a female main part.

6. A signal plug comprising:

a) main plug part having:

i) a metallic receiving portion; and ii) a line connecting portion inserted into the metallic receiving portion and having an insulation member, two metallic pieces separated by the insulation member, and an insertion-connecting portion formed on a front end thereof;

b) an external sleeve connected to the main plug part and having a hole on a first end thereof, the insertion-connecting portion protruding outwardly from the hole; and c) a fixing sleeve having a first thread, wherein the metallic receiving portion including a shoulder on a front end thereof, the external sleeve includes a radially reduced portion on the first end and a second thread on a second end thereof, the external sleeve is connected to the fixing sleeve by the first thread engaging the second thread thereby fixing the main plug part in the external sleeve.

7. The signal plug according to claim 6, wherein an exterior of the radially reduced portion has a polygonal cross section.

8. A signal plug comprising:

a) main plug part having:

i) a metallic receiving portion; and ii) a line connecting portion inserted into the metallic receiving portion and having an insulation member, two metallic pieces separated by the insulation member, and an insertion-connecting portion formed on a front end thereof;

b) an external sleeve connected to the main plug part and having a hole on a first end thereof, the insertion-connecting portion protruding outwardly from the hole, wherein the main plug part is inserted into the external sleeve, a plurality of blades of a barrel of the main plug part are inserted into the radially reduced portion of the external sleeve with a predetermined length of the plurality of blades extending outwardly from the external sleeve.

* * * * *